US011008533B2

(12) United States Patent
Shen et al.

(10) Patent No.: US 11,008,533 B2
(45) Date of Patent: May 18, 2021

(54) HOME CARE COMPOSITIONS

(71) Applicant: COLGATE-PALMOLIVE COMPANY, New York, NY (US)

(72) Inventors: Hongwei Shen, Holmdel, NJ (US); Charles Schramm, Jr., Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 50 days.

(21) Appl. No.: 16/233,368

(22) Filed: Dec. 27, 2018

(65) Prior Publication Data

US 2020/0208081 A1 Jul. 2, 2020

(51) Int. Cl.
*C11D 3/00* (2006.01)
*C11D 1/88* (2006.01)

(52) U.S. Cl.
CPC ..... *C11D 3/0015* (2013.01); *C11D 1/883* (2013.01)

(58) Field of Classification Search
CPC ..... C11D 3/0015
See application file for complete search history.

(56) References Cited

U.S. PATENT DOCUMENTS

| | | | | |
|---|---|---|---|---|
| 9,758,927 | B2 * | 9/2017 | Acosta | D06M 15/53 |
| 2018/0193236 | A1 * | 7/2018 | Son | A61K 8/36 |

FOREIGN PATENT DOCUMENTS

| | | | | |
|---|---|---|---|---|
| CN | 109023933 | A * | 12/2018 | |
| EP | 1019478 | A1 * | 7/2000 | C11D 3/3719 |
| EP | 3342395 | | 7/2018 | |
| WO | 1998/000500 | | 1/1998 | |
| WO | WO-9800500 | A1 * | 1/1998 | D06M 15/15 |
| WO | 2009/030601 | | 3/2009 | |
| WO | WO-2009030601 | A1 * | 3/2009 | C11D 3/0015 |

OTHER PUBLICATIONS

Gao Jinghua. CN 109023933 A. English translation. (Year: 2020).*
International Search Report and Written Opinion of the International Searching Authority in International Application No. PCT/US2018/067599, dated Sep. 16, 2019.

* cited by examiner

*Primary Examiner* — Mark Eashoo
*Assistant Examiner* — M. Reza Asdjodi

(57) ABSTRACT

Described herein are fabric care compositions comprising an esterquat, and a carbodiimide; along with methods of making and using same.

13 Claims, No Drawings

HOME CARE COMPOSITIONS

BACKGROUND

Fabric care compositions (e.g. fabric conditioners) can be applied to laundry during the rinse cycle in a washing machine. In contrast to laundry detergents, fabric softeners may be regarded as an after-treatment laundry aid.

Machine washing puts great mechanical stress on textiles, particularly natural fibers such as cotton and wool. The fibers at the fabric surface are squashed and frayed, and this condition hardens while drying the laundry in the air, giving the laundry a harsh feel. Adding a liquid fabric softener to the final rinse (rinse-cycle softener) results in the laundry that feels softer.

Fabric softeners are usually either in the form of a liquid, which is added to the washing machine during the rinse cycle (either by the machine itself or through use of a dispensing ball); or as a dryer sheet which is added to the moist laundry at the beginning of the dryer cycle. Liquid fabric softeners can be added manually during the rinse cycle or automatically if the machine has a dispenser designed for this purpose.

Fabric softeners coat the surface of fabric with chemical compounds that are electrically charged, causing threads to stand up from the surface and thereby imparting a softer and fluffier texture. Cationic softeners bind by electrostatic attraction to the negatively charged groups on the surface of the fibers and neutralize their charge. The long aliphatic chains then line up towards the outside of the fiber, imparting lubricity.

Rinse-cycle softeners usually contain cationic surfactants of the quaternary ammonium type as the main active ingredient. Cationic surfactants adhere well to natural fibers (wool, cotton), but less so to synthetic fibers. Cationic softeners are incompatible with anionic surfactants in detergents because they combine with them to form a solid precipitate. This requires that the softener is added in the rinse cycle. Fabric softener reduces the absorbency of textiles, which adversely affects the function of towels and microfiber cloth.

Formerly, the active material of most softeners in Europe, the USA, and Japan, were ditallowdimethylammonium chloride (DTDMAC) and distearyldimethylammonium chloride (DSDMAC). Due to their poor biodegradability, they were replaced by the readily biodegradable esterquats in the 1980s and 1990s.

A domestic laundry fabric softener is disclosed in U.S. Pat. No. 3,915,867. That patent teaches a self-emulsifying domestic laundry fabric active softener base comprised of N-methyl, N,N-di-(β-$C_{14}$-$C_{18}$ acyloxy ethyl), N-β-hydroxy ethyl ammonium metho sulfate characterized by good softening, outstanding whiteness-retention and excellent rewetting properties and has a light color having an index on the Gardner scale in the range of about 1 to 2. The active softener base is dispersed in an inert vehicle such as isopropanol and/or water and may be intermixed with other additives, such as perfumes, nonionic wetting agents, optical brighteners, etc.

Esterquats, a class of cationic fabric softeners, are reviewed by S. Mishra, V. K. Tyagi in J. Oleo Sci., vol. 56, iss. 6, pp 269 to 276. Esterquats, which are quaternary ammonium compounds having two long ($C_{16}$-$C_{18}$) fatty acid chains with 2 weak ester linkages, represent a new generation of fabric softening agents, having replaced the dialkyldimethylammonium salts (e.g., DTDMAC and DSDMAC). The inclusion of ester linkages into the aliphatic chains has significantly improved the kinetics of biodegradation of the cationic surfactants, lowering the environmental exposure levels. This generation of fabric softening agents combines a good environmental profile with the structural features required for an effective fabric conditioner. The paper reviewed the synthesis, types, actives combines a good environmental profile with the structural features required for a properties and applications of esterquats.

Esterquats are commonly used in fabric conditioners, however, they have a drawback: esterquats tend to hydrolyze at elevated temperatures. Such elevated temperatures are typically encountered in tropical climates. Additionally, such elevated temperatures are frequently encountered during the transportation vessels such as in hot trucks, and intermodal containers. Further such elevated temperatures are frequently encountered in warehouses. Finally, such elevated temperatures are sometimes found in laundry rooms, Laundromats, and facilities where heat is generated during the washing phase and the drying phase of doing laundry. One of the degradation pathways of the fabric conditioner is the hydrolysis of esterquat, to release free fatty acids. Free fatty acids have low solubilities in water and tend to precipitate out of the fabric conditioner as white fatty flakes. Such precipitation is undesirable from both efficacy and aesthetic considerations.

Clearly, a method of mitigating esterquat hydrolysis is needed. Embodiments of the present invention are designed to meet these, and other, needs.

BRIEF SUMMARY

The present invention is directed to a fabric conditioner composition comprising an esterquat, and a carbodiimide.

Advantages of the present invention is a reduction of the hydrolysis of esterquats in the fabric conditioners, reduction of residual fatty odor, and mitigation of fatty acid precipitation.

It is hypothesized that the observed improvement is due to the conjugation of free fatty. Free fatty acid are believed to facilitate hydrolysis of esterquat fabric conditioner emulsions.

The carbodiimide is a compound of formula R—N═C═N—R', wherein R and R' are each independently organic groups. Under one embodiment, organic groups R and R' are each independently a $C_{1-6}$ alkyl group, an aryl group, a cycloalkyl group, or an aminoalkene group.

The definition of a $C_{1-6}$ alkyl group as used herein includes saturated hydrocarbyl groups with one to six carbons that are straight chains, branched, and alicyclic.

Because the solubility of organic compounds in water decreases with increasing size of hydrocarbyl groups, carbodiimides with small (i.e., 6 carbons or less) hydrocarbyl groups are preferred.

Aryl group may be phenyl, benzyl, phenyl substituted with one or more small hydrocarbyl groups, benzyl, benzyl substituted with one or more small hydrocarbyl groups, and mixtures thereof.

Cycloalkyl group is a hydrocarbyl group that comprises a cyclic saturated component. Under one embodiment, the cycloalkyl group is a cyclic saturated hydrocarbyl. The cycloalkyl group may be a substituted cyclic saturated hydrocarbyl, a linear group that is substituted with a cyclic saturated group Under one embodiment, one or both of the organic groups R and R' are an aminoalkene group. The definition of the term "aminoalkene" includes aminoalkene that is unsubstituted on the nitrogen, aminoalkene that is substituted on the nitrogen by one further alkyl group, and aminoalkene that is substituted on the nitrogen by two further alkyl groups.

Under one embodiment, the aminoalkene group is $—(CH_2)_xNR^mR^n$; wherein x is a number from 1 to 5, and $R^m$ and $R^n$ are each independently H or $C_{1-6}$ alkyl groups.

Under one embodiment, the organic groups R and R' are identical. Examples of carbodiimides wherein R═R' includes N,N'-dicyclohexylcarbodiimide, N,N'-diisopropylcarbodiimide, and N,N'-diphenylcarbodiimide.

Under one embodiment, the organic groups R and R' are different. Examples of carbodiimides wherein R≠R' includes N-(3-dimethylaminopropyl)-N'-ethylcarbodiimide, 1-[3-(dimethylamino)propyl]-3-ethylcarbodiimide methiodide, and mixtures thereof.

N-(3-dimethylaminopropyl)-N'-ethylcarbodiimide has the structure $CH_3—CH_2—N═C═N—(CH_2)_3—NMe_2$. N-(3-dimethylaminopropyl)-N'-ethylcarbodiimide is water soluble.

Under one embodiment, the carbodiimide is water dispersible.

The carbodiimide is in monomeric form, or a dimeric form, or a polymeric form. Under one embodiment, the carbodiimide is a mixture of at least one of monomer, dimer, and polymer. Many dialkylcarbodiimides prefer the monomeric form. Many diarylcarbodiimides upon standing convert to dimers, and to polymers at room temperature.

The carbodiimide of the present invention may be prepared by any of the commercially available routes, including preparation by dehydrosulfurization of thioureas, or preparation from isocyanates.

An esterquat comprises a quaternary ammonium cation comprising fatty acid chains linked by weak ester linkages. Esterquats are useful as fabric softening agents, having replaced the dialkyldimethylammonium salts. The ester linkages in the aliphatic chains significantly improves the kinetics of biodegradation of the cationic surfactants, lowering the environmental exposure levels.

Under one embodiment, the esterquat is a quaternary ammonium compound of formula $[R^aR^bR^cR^dN^+][X^-]$, wherein $R^a$, $R^b$ and $R^c$ are each independently $—(CH_2)_g—R^e$, wherein $R^e$ is OH or an alkanoyloxy group containing from 8 to 22 carbon atoms; $R^d$ is a hydrocarbyl group comprising 1 to 12 carbon atoms; g is a number from 1 to 3; and $X^-$ is a softener compatible anion.

The esterquat may be a monoesterquat, a diesterquat, or a triesterquat. Further the esterquat may be a mixture of esterquats. Under one embodiment, the esterquat is a mixture of about 20 wt % to about 40 wt % of monoesterquat, about 50 wt % to about 65 wt % of diesterquat, and about 10 wt % to about 25 wt % triesterquat.

Under one embodiment, the esterquat is a quaternary ammonium cation comprising fatty acid chains linked by weak ester linkages. $X^-$, the counterion for the quaternary ammonium cation, is a softener compatible anion. Examples of suitable softener compatible anions include chloride, bromide, methylsulfate, ethylsulfate, sulfate, phosphate, or nitrate, formate, lactate, benzoate, and mixtures thereof.

The present invention is directed to a fabric conditioner composition comprising an esterquat, a carbodiimide, and optionally, additional ingredients. Such ingredients include fragrances, surfactants, thickening polymers, colorants, clays, buffers, chelating compounds, silicones, fatty alcohols, and fatty esters At least thirteen aspects define the invention.

In the first aspect, the invention relates to a fabric conditioner composition comprising an esterquat, and a carbodiimide.

In the second aspect, the invention relates to a fabric conditioner composition comprising an esterquat, and a carbodiimide, wherein the carbodiimide is a compound of formula R—N═C═N—R', wherein R and R' are each independently $C_{1-6}$ alkyl, aryl, cycloalkyl, or $—(CH_2)_xNR^mR^n$; wherein x is a number from 1 to 5, and $R^m$ and $R^n$ are each independently H or $C_{1-6}$ alkyl.

In the third aspect, the invention relates to a fabric conditioner composition comprising an esterquat, and a carbodiimide, wherein the carbodiimide is selected from the group consisting of N,N'-dicyclohexylcarbodiimide, N,N'-diisopropylcarbodiimide, N,N'-diphenylcarbodiimide, N-(3-dimethylaminopropyl)-N'-ethylcarbodiimide, N-ethyl-N'-(3-dimethylaminopropyl)carbodiimide, 1-[3-(dimethylamino)propyl]-3-ethylcarbodiimide methiodide, N-(3-dimethylaminopropyl)-N'-ethylcarbodiimide, an adduct thereof, a dimer thereof, a polymer thereof, and mixture thereof.

In the fourth aspect, the invention relates to a fabric conditioner composition comprising an esterquat, and a carbodiimide, wherein the carbodiimide is a dimer of a compound of formula R—N═C═N—R', wherein R and R' are each independently is a $C_{1-6}$ alkyl, aryl, cycloalkyl, or $—(CH_2)_xNR^mR^n$; wherein x is an integer from 1 to 3, $R^m$ and $R^n$ are each independently $C_{1-6}$ alkyl.

In the fifth aspect, the invention relates to a fabric conditioner composition comprising an esterquat, and a carbodiimide, wherein the carbodiimide is a polymer of a compound of formula R—N═C═N—R', wherein R and R' are each independently is a $C_{1-6}$ alkyl, aryl, cycloalkyl, or $—(CH_2)_xNR^mR^n$; wherein x is an integer from 1 to 3, $R^m$ and $R^n$ are each independently $C_{1-6}$ alkyl.

In the sixth aspect, the invention relates to a fabric conditioner composition comprising an esterquat, and a carbodiimide selected from the group consisting of 1-ethyl-3-(3-dimethylaminopropyl)carbodiimide, an adduct thereof, a dimer thereof, a polymer thereof, and mixture thereof.

In the seventh aspect, the invention relates to a fabric conditioner composition comprising an esterquat, and a water disperable carbodiimide.

In the eighth aspect, the invention relates to a fabric conditioner composition comprising an esterquat, and a carbodiimide, wherein the esterquat is a quaternary ammonium compound of formula $[R^aR^bR^cR^dN+][X^-]$, wherein $R^a$, $R^b$ and $R^c$ are each independently $—(CH_2)_g—R^e$, wherein $R^e$ is OH or an alkoxy hydrocarbyl group containing from 8 to 22 carbon atoms; $R^d$ is a hydrocarbyl group comprising 1 to 12 carbon atoms; g is a number from 1 to 3; and $X^-$ is a softener compatible anion.

In the ninth aspect, the invention relates to a fabric conditioner composition comprising an esterquat, and a carbodiimide, wherein the esterquat is a quaternary ammonium compound of formula $[R^aR^bR^cR^dN^+][X^-]$, wherein $R^a$, $R^b$ and $R^c$ are each independently $—(CH_2)_g—R^e$, wherein $R^e$ is OH or an alkoxy hydrocarbyl group containing from 8 to 22 carbon atoms; $R^d$ is a hydrocarbyl group comprising 1 to 12 carbon atoms; g and h are each independently an integer from 1 to 3; and $X^-$ is a softener compatible anion, wherein at least one of the hydrocarbyl group is an aliphatic group containing 0 to 3 double bonds.

In the tenth aspect, the invention relates to a fabric conditioner composition comprising an esterquat, and a carbodiimide, wherein the esterquat is a quaternary ammonium compound of formula $[R^aR^bR^cR^dN^+][X^-]$, wherein $R^a$, $R^b$ and $R^c$ are each independently $—(CH_2)_g—R^e$, wherein $R^e$ is OH or an alkoxy hydrocarbyl group containing from 8 to 22 carbon atoms; $R^d$ is a hydrocarbyl group comprising 1 to 12 carbon atoms; g and h are each independently an integer from 1 to 3; and $X^-$ is a softener compatible anion, wherein at least one of the hydrocarbyl group is an aliphatic group containing 0 to 3 double bonds, wherein the aliphatic group is linear.

In the eleventh aspect, the invention relates to a fabric conditioner composition comprising an esterquat, and a carbodiimide, wherein the esterquat is a quaternary ammonium compound of formula $[R^1R^2R^3N^+—(CH_2)_q—O—CO—R^4][X^-]$, wherein $R^4$ is an aliphatic hydrocarbyl group comprising 8 to 22 carbon atoms; $R^2$ and $R^3$ are each independently $—(CH_2)_s—R^5$, wherein $R^5$ is an alkoxy carbonyl group containing from 8 to 22 carbon atoms, benzyl, phenyl, $C_{1-4}$ alkyl substituted phenyl, OH, or H; $R^1$ is $—(CH_2)_t—R^6$, wherein $R^6$ is benzyl, phenyl, $C_{1-4}$ alkyl substituted phenyl, OH, or H; q, s, and t are each independently a number from 1 to 3; and $X^-$ is a softener compatible anion.

In the twelfth aspect, the invention relates to a fabric conditioner composition comprising an esterquat, a carbodiimide, and a cationic surfactant.

In the thirteenth aspect, the invention relates to a fabric conditioner composition comprising an esterquat, and a carbodiimide, wherein the esterquat is a mixture of about 20 wt % to about 40 wt % of monoesterquat, about 50 wt % to about 65 wt % of diesterquat, and about 10 wt % to about 25 wt % triesterquat.

DETAILED DESCRIPTION

For illustrative purposes, the principles of the present invention are described by referencing various exemplary embodiments thereof. Although certain embodiments of the invention are specifically described herein, one of ordinary skill in the art will readily recognize that the same principles are equally applicable to, and can be employed in other apparatuses and methods. Before explaining the disclosed embodiments of the present invention in detail, it is to be understood that the invention is not limited in its application to the details of any particular embodiment shown. The terminology used herein is for the purpose of description and not of limitation.

As used herein and in the appended claims, the singular forms "a", "an", and "the" include plural references unless the context dictates otherwise. The singular form of any class of the ingredients refers not only to one chemical species within that class, but also to a mixture of those chemical species; for example, the term "esterquat" in the singular form, may refer to a mixture of compounds each of which is also an esterquat. The terms "a" (or "an"), "one or more" and "at least one" may be used interchangeably herein. The terms "comprising", "including", and "having" may be used interchangeably. The term "include" should be interpreted as "include, but are not limited to". The term "including" should be interpreted as "including, but not limited to".

The abbreviations and symbols as used herein, unless indicated otherwise, take their ordinary meaning. The abbreviation "wt %" means percent by weight. The symbol "°" refers to a degree, such as a temperature degree or a degree of an angle.

When referring to chemical structures, and names, the symbols "C", "H", and "O" mean carbon, hydrogen, and oxygen, respectively. The symbols "—" and "═" mean single bond, and double bond, respectively.

The term "about" when referring to a number means any number within a range of 10% of the number. For example, the phrase "about 0.050 wt %" refers to a number between and including 0.04500 wt % and 0.05500 wt %.

As used throughout, ranges are used as shorthand for describing each and every value that is within the range. Any value within the range can be selected as the terminus of the range.

The term "mixture" is to be interpreted broadly. It refers to a solution, an emulsion, a dispersion, a mixture displaying the Tyndall effect, or any other homogeneous mixture. Under one embodiment, the mixture is shelf stable. When referring to a list of ingredients, unless specifically indicated otherwise, the term "mixture" refers to a mixture of the aforementioned ingredients with each other, a mixture of any of aforementioned ingredients with other ingredients that are not aforementioned, and to a mixture of several aforementioned ingredients with other ingredients that are not aforementioned.

Any member in a list of species that are used to exemplify or define a genus, may be mutually different from, or overlapping with, or a subset of, or equivalent to, or nearly the same as, or identical to, any other member of the list of species. Further, unless explicitly stated, such as when reciting a Markush group, the list of species that define or exemplify the genus is open, and it is given that other species may exist that define or exemplify the genus just as well as, or better than, any other species listed.

For readability purposes, the chemical functional groups are in their adjective form; for each of the adjective, the word "group" is assumed. For example, the adjective "cyclopropyl" without a nouns thereafter, should be read as "a cyclopropyl group".

All references cited herein are hereby incorporated by reference in their entireties. In the event of a conflict in a definition in the present disclosure and that of a cited reference, the present disclosure controls The present invention is directed to a fabric conditioner composition comprising an esterquat, and a carbodiimide.

A common problem with many fabric conditioners is that they tend to degrade at high temperatures. Such high temperatures are frequently encountered in tropical area, as well as in self-service laundry facilities with a large number of washers and dryers. One of the degradation pathways is the hydrolysis of esterquat, a fabric softening agent, to release free fatty acids. Free fatty acids have low solubilities in water, and tend to precipitate out of the fabric conditioner as white fatty flakes. Such precipitation is undesirable from both efficacy and aesthetic considerations.

One of the advantages of the present invention is that the use of carbodiimides in a fabric conditioner reduces the hydrolysis of esterquats in the fabric conditioners.

Further, one advantage of the present invention is that the use of carbodiimides in a fabric conditioner reduces residual fatty odor.

Another advantage of the present invention is that the use of carbodiimides in a fabric conditioner mitigates the problem with fatty acid precipitation.

The observed improvements of decreased monoesterquat drop and decreased fatty odor exhibited by the fabric conditioner comprising a carbodiimide over the corresponding fabric conditioner without the carbodiimide are not well understood. While not wishing to be bound by theory, it is hypothesized that the observed improvement are due to conjugation of free fatty. Free fatty acid are believed to facilitate hydrolysis of esterquat fabric conditioner emulsions.

The conjugation of a free fatty acid with a carbodiimide is illustrated in the following example of a reaction of an octodecyl acid with 1-ethyl-3-(3-dimethylaminopropyl)carbodiimide.

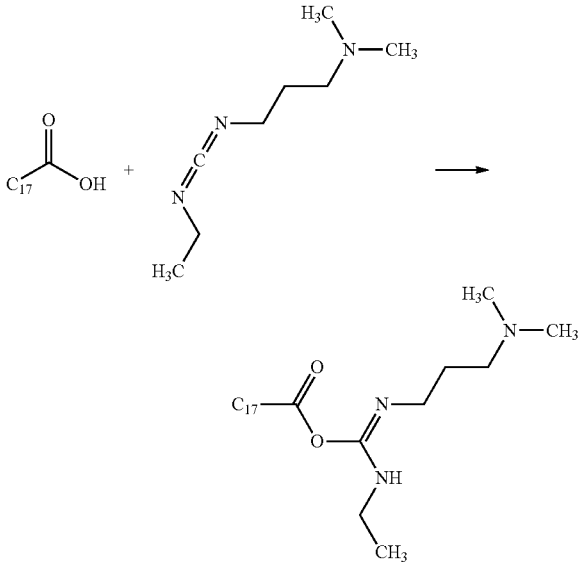

This conjugation forms an o-acylisourea ester. The acylisourea ester is an active ester that may further react. Further reactions of the acylisourea may occur with primary amines to form isourea byproducts.

The present invention is directed to a fabric conditioner comprising an esterquat and a carbodiimide. The carbodiimide is a compound of formula R—N=C=N—R', wherein R and R' are each independently organic groups.

Under one embodiment, organic groups R and R' are each independently a $C_{1-6}$ alkyl group, an aryl group, a cycloalkyl group, or an aminoalkene group.

The definition of a $C_{1-6}$ alkyl group as used herein includes saturated hydrocarbyl groups with one to six carbons, that are straight chains, branched, and alicyclic. Examples of a suitable $C_{1-6}$ alkyl group include —$CH_3$, —$C_2H_5$, —$C_3H_7$, —$C_4H_9$, —$C_5H_{11}$, —$C_6H_{13}$, and mixtures thereof.

Examples of suitable straight chain alkyl groups include methyl, ethyl, n-propyl, n-pentyl, n-hexyl, and mixtures thereof.

Examples of a suitable alkyl group include propyl, pentyl, hexyl, and mixtures thereof, wherein each of the groups is not linear. Examples of a suitable $C_{1-6}$ alkyl group include 1-methylpropyl; sec-butyl; 2-methylpropyl; iso-butyl; 1,1-dimethylethyl; tert-butyl; 1-methylbutyl; sec-pentyl; 2-methylbutyl; 3-methylbutyl; 1-ethylpropyl; 3-pentyl; 1,1-dimethylpropyl; tert-pentyl; 1,2-dimethylpropyl; 2,2-dimethylpropyl; neopentyl; 1-methylpentyl; 2-methylpentyl; 3-methylpentyl; 4-methylpentyl; iso-amyl; 1,1-dimethylbutyl; 1,2-dimethylbutyl; 1,3-dimethylbutyl; 2,2-dimethylbutyl; 2,3-dimethylbutyl, 3,3-dimethylbutyl; 1-ethylbutyl; 2-ethylbutyl; 1,1,2-trimethylpropyl; 1,2,2-trimethylpropyl; 1-ethyl-1-methylpropyl, 1-ethyl-2-methylpropyl; and mixtures thereof.

Because the solubility of organic compounds in water decreases with increasing size of hydrocarbyl groups, carbodiimides with small (i.e., 6 carbons or less) hydrocarbyl groups are preferred.

The definition of an aryl group includes phenyl, benzyl, phenyl substituted with one or more small hydrocarbyl groups, benzyl, benzyl substituted with one or more small hydrocarbyl groups, and mixtures thereof. Under one embodiment, the aryl group has 12 carbons or less. Under one embodiment, the aryl group has 10 carbons or less. Under one embodiment, the aryl group has 8 carbons or less. Under one embodiment, the aryl group has 6 carbons.

Cycloalkyl group is hydrocarbyl group that comprises acyclic saturated component. Under one embodiment, the cycloalkyl group is a cyclic saturated hydrocarbyl. Examples of a suitable cycloalkyl group include cyclopropyl, cyclobutyl, cyclopentyl, cyclohexyl, cycloheptyl, and mixtures thereof.

Under one embodiment, the cycloalkyl group is a substituted cyclic saturated hydrocarbyl. Examples of a cycloalkyl group include methylcyclopropyl, methylcyclobutyl, methylcyclopentyl, methylcyclohexyl, methylcycloheptyl, ethylcyclopropyl, ethylcyclobutyl, ethylcyclopentyl, ethylcyclohexyl, ethylcycloheptyl, dimethylcyclopropyl, dimethylcyclobutyl, dimethylcyclopentyl, dimethylcyclohexyl, dimethylcycloheptyl, diethylcyclopropyl, diethylcyclobutyl, diethylcyclopentyl, diethylcyclohexyl, diethylcycloheptyl, and mixtures thereof.

Under one embodiment, the cycloalkyl group is a linear group that is substituted with a cyclic saturated group. The substitution may occur at the end of the chain, or anywhere along the chain. Examples of a linear group that is substituted with a cyclic saturated group include cyclopropylmethylene, cyclopropylethylene, cyclopropylpropylene, cyclopropylbutylene, cyclobutylmethylene, cyclobutylethylene, cyclobutylpropylene, cyclobutylbutylene, cyclopentylmethylene, cyclopentylethylene, cyclopentylpropylene, cyclopentylbutylene, cyclohexylmethylene, cyclohexylethylene, cyclohexylpropylene, cyclohexylbutylene, 1-cyclopropylethyl, 2-cyclopropylethyl, 1-cyclobutylethyl, 2-cyclobutylethyl, 1-cyclopentylethyl, 2-cyclopentylethyl, 1-cyclohexylethyl, 2-cyclohexylethyl, 1-cyclopropylpropyl, 2-cyclopropylpropyl, 3-cyclopropylpropyl, 1-cyclobutylpropyl, 2-cyclobutylpropyl, 3-cyclobutylpropyl, 1-cyclopentylpropyl, 2-cyclopentylpropyl, 3-cyclopentylpropyl, 1-cyclohexylpropyl, 2-cyclohexylpropyl, 3-cyclohexylpropyl, 1-cyclopropylbutyl, 2-cyclopropylbutyl, 3-cyclopropylbutyl, 4-cyclopropylbutyl, 1-cyclobutylbutyl, 2-cyclobutylbutyl, 3-cyclobutylbutyl, 4-cyclobutylbutyl, 1-cyclopentylbutyl, 2-cyclopentylbutyl, 3-cyclopentylbutyl, 4-cyclopentylbutyl, 1-cyclohexylbutyl, 2-cyclohexylbutyl, 3-cyclohexylbutyl, 4-cyclohexylbutyl, and mixtures thereof. The alkylenes in these examples are divalent bridging groups; thus for example, the term cyclopropylmethylene has the structure —$CH_2$—$C_3H_5$, wherein $C_3H_5$ is a cyclopropyl group.

[---Carbodiimides, R=aminoalkene]

Under one embodiment, one or both of the organic groups R and R' are an aminoalkene group. The definition of the term "aminoalkene" includes aminoalkene that is unsubstituted on the nitrogen, aminoalkene that is substituted on the nitrogen by one further alkyl group, and aminoalkene that is substituted on the nitrogen by two further alkyl groups.

Under one embodiment, the aminoalkene group is —$(CH_2)_xNR^mR^n$; wherein x is a number from 1 to 5, and $R^m$ and $R^n$ are each independently H or $C_{1-6}$ alkyl groups.

Examples of —$(CH_2)_xNR^mR^n$ wherein x is a number from 1 to 5, and $R^m$ and $R^n$ are each independently H or $C_{1-6}$ alkyl, includes aminomethylene, methylaminomethylene, ethylaminomethylene, propylaminomethylene, butylaminomethylene, pentylaminomethylene, hexylaminomethylene, dimethylaminomethylene, methylethylaminomethylene, methylpropylaminomethylene, methylbutylaminomethylene, methylpentylaminomethylene, methylhexylaminomethylene, diethylaminomethylene, ethylpropylaminomethylene, ethylbutylaminomethylene, ethylpentylaminomethylene, ethylhexylaminomethylene, dipropylaminomethylene, propylbutylaminomethylene, propylpentylaminomethylene, propylhexylaminomethylene, dibutylaminomethylene, butylpentylaminomethylene, butylhexylaminomethylene, dipentylaminomethylene, pentylhexylaminomethylene, dihexylaminomethylene, aminoethylene, methylaminoethylene, ethylaminoethylene, propylaminoethylene, butylaminoethylene, pentylaminoethylene, hexylaminoethylene, dimethylaminoethylene, methylethylaminoethylene, methylpropylaminoethylene, methylbutylaminoethylene, methylpentylaminoethylene, methylhexylaminoethylene, diethylaminoethylene, ethylpropylaminoethylene, ethylbutylaminoethylene, ethylpentylaminoethylene, ethylhexylaminoethylene, dipropylaminoethylene, propylbutylaminoethylene, propylpentylaminoethylene, propylhexylaminoethylene, dibutylaminoethylene, butylpentylaminoethylene, butylhexylaminoethylene, dipentylaminoethylene, pentylhexylaminoethylene, dihexylaminoethylene, aminopropylene, methylaminopropylene, ethylaminopropylene, propylaminopropylene, butylaminopropylene, pentylaminopropylene, hexylaminopropylene, dimethylaminopropylene, methylethylaminopropylene, methylpropylaminopropylene, methylbutylaminopropylene, methylpentylaminopropylene, methylhexylaminopropylene, diethylaminopropylene, ethylpropylaminopropylene, ethylbutylaminopropylene, ethylpentylaminopropylene, ethylhexylaminopropylene, dipropylaminopropylene, propylbutylaminopropylene, propylpentylaminopropylene, propylhexylaminopropylene, dibutylaminopropylene, butylpentylaminopropylene, butylhexylaminopropylene, dipentylaminopropylene, pentylhexylaminopropylene, dihexylaminopropylene, aminobutylene, methylaminobutylene, ethylaminobutylene, propylaminobutylene, butylaminobutylene, pentylaminobutylene, hexylaminobutylene, dimethylaminobutylene, methylethylaminobutylene, methylpropylaminobutylene, methylbutylaminobutylene, methylpentylaminobutylene, methylhexylaminobutylene, diethylaminobutylene, ethylpropylaminobutylene, ethylbutylaminobutylene, ethylpentylaminobutylene, ethylhexylaminobutylene, dipropylaminobutylene, propylbutylaminobutylene, propylpentylaminobutylene, propylhexylaminobutylene, dibutylaminobutylene, butylpentylaminobutylene, butylhexylaminobutylene, dipentylaminobutylene, pentylhexylaminobutylene, dihexylaminobutylene, aminopentylene, methylaminopentylene, ethylaminopentylene, propylaminopentylene, butylaminopentylene, pentylaminopentylene, hexylaminopentylene, dimethylaminopentylene, methylethylaminopentylene, methylpropylaminopentylene, methylbutylaminopentylene, methylpentylaminopentylene, methylhexylaminopentylene, diethylaminopentylene, ethylpropylaminopentylene, ethylbutylaminopentylene, ethylpentylaminopentylene, ethylhexylaminopentylene, dipropylaminopentylene, propylbutylaminopentylene, propylpentylaminopentylene, propylhexylaminopentylene, dibutylaminopentylene, butylpentylaminopentylene, butylhexylaminopentylene, dipentylaminopentylene, pentylhexylaminopentylene, dihexylaminopentylene, aminohexylene, methylaminohexylene, ethylaminohexylene, propylaminohexylene, butylaminohexylene, pentylaminohexylene, hexylaminohexylene, dimethylaminohexylene, methylethylaminohexylene, methylpropylaminohexylene, methylbutylaminohexylene, methylpentylaminohexylene, methylhexylaminohexylene, diethylaminohexylene, ethylpropylaminohexylene, ethylbutylaminohexylene, ethylpentylaminohexylene, ethylhexylaminohexylene, dipropylaminohexylene, propylbutylaminohexylene, propylpentylaminohexylene, propylhexylaminohexylene, dibutylaminohexylene, butylpentylaminohexylene, butylhexylaminohexylene, dipentylaminohexylene, pentylhexylaminohexylene, dihexylaminohexylene, and mixtures thereof.

Under one embodiment, the organic groups R and R' are identical. Examples of carbodiimides wherein R=R' includes N,N'-dicyclohexylcarbodiimide, N,N'-diisopropylcarbodiimide, and N,N'-diphenylcarbodiimide.

Under one embodiment, the organic groups R and R' are different. Examples of carbodiimides wherein R≠R' includes N-(3-dimethylaminopropyl)-N'-ethylcarbodiimide, N-ethyl-N'-(3-dimethylaminopropyl)carbodiimide, EDC, WSC, N-(3-dimethylaminopropyl)-N'-ethylcarbodiimide hydrochloride, N-ethyl-N'-(3-dimethylaminopropyl)carbodiimide hydrochloride, EDAC, EDC hydrochloride, WSC hydrochloride, 1-[3-(dimethylamino)propyl]-3-ethylcarbodiimide methiodide, and mixtures thereof.

The compound N-(3-dimethylaminopropyl)-N'-ethylcarbodiimide is referred to, under one embodiment, as 1-ethyl-3-(3-dimethylaminopropyl)carbodiimide. Under one embodiment, the compound N-(3-dimethylaminopropyl)-N'-ethylcarbodiimide is referred to as 3-(ethyliminomethyleneamino)-N,N-dimethylpropan-1-amine. N-(3-dimethylaminopropyl)-N'-ethylcarbodiimide has the structure $CH_3$—$CH_2$—N=C=N—$(CH_2)_3$—$NMe_2$. N-(3-dimethylaminopropyl)-N'-ethylcarbodiimide is water soluble.

Under one embodiment, the carbodiimide is water disperable. Water disperable means that the carbodiimide mixes well with water and other ingredients in the fabric conditioner composition. The phrase "water disperable" includes any stable or semi-stable homogenous mixture. Examples of water disperable mixture include a solution, an emulsion, a dispersion, a mixture displaying the Tyndall effect, or any other homogeneous mixture.

Under one embodiment, the carbodiimide is in monomeric form. Under another embodiment, the carbodiimide is in a dimeric form. Under one embodiment, the carbodiimide is in polymeric form. Under one embodiment, the carbodiimide is a mixture of at least one of monomer, dimer, and polymer.

Many dialkylcarbodiimides prefer the monomeric form. Many diarylcarbodiimides upon standing convert to dimers, and to polymers at room temperature.

Polymers based on carbodiimides are formed from monomers by the following reaction.

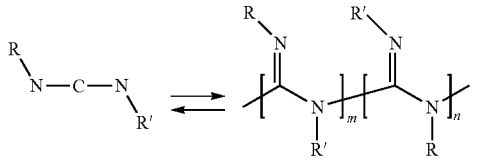

Under one embodiment, the asymmetric carbodiimides polymerize into regioregular polycarbodiimides. In regioregular polycarbodiimides, the R and R' groups prefer one or the other position on the polymer, i.e., m<<n or m>>n in the above chemical equation.

Under one embodiment, the asymmetric carbodiimides polymerize into regioirregular polycarbodiimides. In regioirregular polycarbodiimides, the R and R' groups have a more random position on the polymer.

The carbodiimide of the present invention may be prepared by any of the commercially available routes.

Under one embodiment, the carbodiimide is prepared by dehydrosulfurization of thioureas. The desulfurization agent may be mercuric oxide as follows:

$$(R(H)N)_2CS+HgO\rightarrow(RN)_2C+HgS+H_2O$$

Under one embodiment, a dehydrating agent is added to the reaction mixture. The dehydration of N,N'-dialkylureas gives carbodiimides as follows:

$$(R(H)N)_2CO\rightarrow(RN)_2C+H_2O$$

Examples of a dehydrating agent includes phosphorus pentoxide and p-toluenesulfonyl chloride.

Further, the carbodiimide of the present invention may be prepared from isocyanates.

Isocyanates convert to carbodiimides with loss of carbon dioxide:

$$2\ RC{=}N{=}O\rightarrow(RN)_2C+CO_2$$

Under one embodiment, the reaction is catalyzed by phosphine oxides. 3-(Ethyliminomethyleneamino)-N,N-dimethylpropan-1-amine may be prepared by coupling ethyl isocyanate to N,N-dimethylpropane-1,3-diamine to give a urea, followed by dehydration.

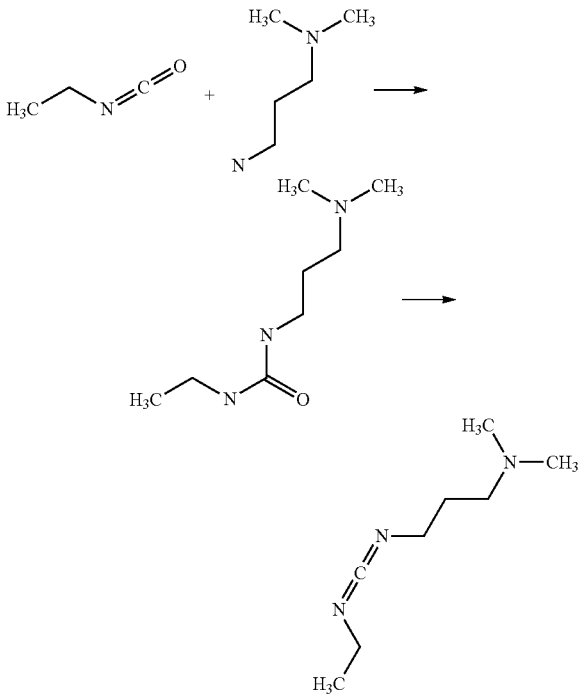

An esterquat comprises a quaternary ammonium cation comprising fatty acid chains linked by weak ester linkages. Esterquats are useful as fabric softening agents, having replaced the dialkyldimethylammonium salts. The ester linkages in the aliphatic chains significantly improves the kinetics of biodegradation of the cationic surfactants, lowering the environmental exposure levels.

Under one embodiment, the esterquat is a quaternary ammonium compound of formula $[R^aR^bR^cR^dN^+][X^-]$, wherein $R^a$, $R^b$ and $R^c$ are each independently $—(CH_2)_g—R^e$, wherein $R^e$ is OH or an alkanoyloxy group containing from 8 to 22 carbon atoms; $R^d$ is a hydrocarbyl group comprising 1 to 12 carbon atoms; g is a number from 1 to 3; and $X^-$ is a softener compatible anion.

The $R^d$ group is a hydrocarbyl group comprising 1 to 12 carbon atoms. The phrase "hydrocarbyl group" means a functional group based on the removal of one hydrogen atom from a hydrocarbon. The phrase "hydrocarbyl group" also means a functional group that consists of carbons and hydrogens.

The definition of the hydrocarbyl group comprising 1 to 12 carbons includes saturated hydrocarbyl groups, monounsaturated hydrocarbyl groups, diunsaturated hydrocarbyl groups, triunsaturated hydrocarbyl groups, polyunsaturated hydrocarbyl groups, aryl hydrocarbyl groups, cycloalkyl group.

Examples of suitable hydrocarbyl groups include alkyl groups, including $—CH_3$, $—C_2H_5$, $—C_3H_7$, $—C_4H_9$, $—C_5H_{11}$, $—C_6H_{13}$, $—C_7H_{15}$, $—C_8H_{17}$, $—C_9H_{19}$, $—C_{10}H_{21}$, $—C_{11}H_{23}$, $—C_{12}H_{25}$, and mixtures thereof. Such a hydrocarbyl group may be linear or branched.

Further examples of suitable hydrocarbyl groups include alkene groups containing one double bond, and cycloalkyl groups. Examples include $—C_2H_3$, $—C_3H_5$, $—C_4H_7$, $—C_5H_9$, $—C_6H_{11}$, $—C_7H_{13}$, $—C_8H_{15}$, $—C_9H_{17}$, $—C_{10}H_{19}$, $—C_{11}H_{21}$, and $—C_{12}H_{23}$. Such a hydrocarbyl group may be linear or branched.

Additional examples of a suitable hydrocarbyl group include alkenyl groups containing two double bonds, alkynyl groups containing a triple bond, cycloalkene groups, and dicycloalkyl groups. Examples include $—C_2H$, $—C_3H_3$, $—C_4H_5$, $—C_5H_7$, $—C_6H_9$, $—C_7H_{11}$, $—C_8H_{13}$, $—C_9H_{15}$, $—C_{10}H_{17}$, $—C_{11}H_{19}$, and $—C_{12}H_{21}$.

Other examples of a suitable hydrocarbyl group include $—C_3H$, $—C_4H_3$, $—C_5H_5$, $—C_6H_7$, $—C_7H_9$, $—C_8H_{11}$, $—C_9H_{13}$, $—C_{10}H_{15}$, $—C_{11}H_{17}$, and $—C_{12}H_{19}$.

Further additional examples of a suitable hydrocarbyl group include $—C_4H$, $—C_5H_3$, $—C_6H_5$, $—C_7H_7$, $—C_8H_9$, $—C_9H_{11}$, $—C_{10}H_{13}$, $—C_{11}H_{15}$, and $—C_{12}H_{17}$.

Under one embodiment, the hydrocarbyl group is an aliphatic group containing 0 to 3 double bonds. Under one embodiment, the aliphatic group is linear.

The $R^a$, $R^b$, and $R^c$ groups are each independently either an alkanol, or an ester thereof.

When the $R^a$, $R^b$, or $R^c$ group is an alkanol, said group is $—(CH_2)_g—R^e$, wherein $R^e$ is OH, and g is a number 1 to 3. When the $R^a$, $R^b$, or $R^c$ group is an alkanol, said group is $—(CH_2)_{1-3}—OH$. Examples of alkanol groups include $—CH_2OH$, $—CH_2CH_2OH$, and $—CH_2CH_2CH_2OH$, and mixture thereof.

When the $R^a$, $R^b$, or $R^c$ group is an ester of an alkanol, said group is $—(CH_2)_g—R^e$, wherein $R^e$ is an alkanoyloxy group containing from 8 to 22 carbon atoms.

The phrase "an alkanoyloxy group containing from 8 to 22 carbon atoms" means a group of formula $—O—C(O)—C_{7-21}$, wherein $C_{7-21}$ is a hydrocarbyl group. When the $R^a$, $R^b$, or $R^c$ group is an ester of an alkanol, said group is $—(CH_2)_{1-3}—O—C(O)—C_{7-21}$, wherein $C_{7-21}$ is a hydrocarbyl group. The hydrocarbyl portion of the alkanoyloxy group may be fully saturated chain, a monounsaturated chain, diunsaturated chain, or a polyunsaturated chain.

For either the alkanol or an ester thereof, under one embodiment, g is an integer, such as 1, 2 or 3. Under one embodiment, g is any real number between 1 and 3, such as 2.5. Non-integer numbers indicate that the esterquat is a mixture; for example, a mixture of 75% methanol and 25% propanol would indicative of g=2.5.

Esterquats may be prepared by a reaction of a carboxylic acid with a tertiary alkanolamine followed by a reaction with an alkylating agent. In the presence of a catalyst, tertiary alkanolamine and fatty acid are heated up to temperatures of 250° C. to obtain a high conversion and water removal. The reaction times vary from a few hours to over 10 hours, depending on the reaction conditions and the reactivity of the components. The esteramine is reacted with alkylating agent like dimethyl sulfate or methyl chloride to obtain the corresponding quaternary ammonium compound, or an esterquat. The resulting esterquat has one alkyl group and three alkanol or esterfied alkanol groups.

Under one embodiment, the esterquat is a monoesterquat. A monoesterquat is a quaternary ammonium compound of formula $[R^aR^bR^cR^dN^+][X^-]$, wherein $R^a$ is $—(CH_2)_g—R^e$, wherein $R^e$ is an alkanoyloxy group containing from 8 to 22 carbon atoms; $R^b$ and $R^c$ are each $—(CH_2)_g—OH$; $R^d$ is a hydrocarbyl group comprising 1 to 12 carbon atoms; g is independently a number from 1 to 3; and $X^-$ is a softener compatible anion. Under one embodiment, a monoesterquat is a mixture of monoesterquats.

Under one embodiment, the esterquat is a diesterquat. A diesterquat is a quaternary ammonium compound of formula $[R^aR^bR^cR^dN^+][X^-]$, wherein $R^a$ and $R^b$ are each independently $—(CH_2)_g—R^e$, wherein $R^e$ is an alkanoyloxy group containing from 8 to 22 carbon atoms; $R^c$ is $—(CH_2)_g—OH$; $R^d$ is a hydrocarbyl group comprising 1 to 12 carbon atoms; g is independently a number from 1 to 3; and $X^-$ is a softener compatible anion. Under one embodiment, a diesterquat is a mixture of diesterquats.

Under one embodiment, the esterquat is a triesterquat. A triesterquat is a quaternary ammonium compound of formula $[R^aR^bR^cR^dN^+][X^-]$, wherein $R^a$, $R^b$ and $R^c$ are each independently $—(CH_2)_g—R^e$, wherein $R^e$ is an alkanoyloxy group containing from 8 to 22 carbon atoms; $R^d$ is a hydrocarbyl group comprising 1 to 12 carbon atoms; g is a number from 1 to 3; and $X^-$ is a softener compatible anion. Under one embodiment, a triesterquat is a mixture of triesterquats.

Under one embodiment, the esterquat is a mixture of esterquats. Under one embodiment, the mixture of esterquats is a mixture of monoesterquats. Under one embodiment, the mixture of esterquats is a mixture of diesterquats. Under one embodiment, the mixture of esterquats is a mixture of triesterquats.

Under one embodiment, the mixture of esterquats is a mixture of a monoesterquat and a diesterquat. Under one embodiment, the mixture of esterquats is a mixture of a monoesterquat and a triesterquat. Under one embodiment, the mixture of esterquats is a mixture of a diesterquat and a triesterquat. Under one embodiment, the mixture of esterquats is a mixture of a monoesterquat, a diesterquat and a triesterquat. Under one embodiment, the mixture of esterquats is a mixture of a monoesterquat and diesterquats. Under one embodiment, the mixture of esterquats is a mixture of monoesterquats and a diesterquat. Under one embodiment, the mixture of esterquats is a mixture of monoesterquats and diesterquats. Under one embodiment, the mixture of esterquats is a mixture of a monoesterquat and triesterquats. Under one embodiment, the mixture of esterquats is a mixture of monoesterquats and a triesterquat. Under one embodiment, the mixture of esterquats is a mixture of monoesterquats and triesterquats. Under one embodiment, the mixture of esterquats is a mixture of a diesterquat and triesterquats. Under one embodiment, the mixture of esterquats is a mixture of diesterquats and a triesterquat. Under one embodiment, the mixture of esterquats is a mixture of diesterquats and a triesterquats.

Under one embodiment, the mixture of esterquats is a mixture of a monoesterquat, a diesterquat and triesterquats. Under one embodiment, the mixture of esterquats is a mixture of a monoesterquat, diesterquats and a triesterquat. Under one embodiment, the mixture of esterquats is a mixture of a monoesterquat, diesterquats and triesterquats. Under one embodiment, the mixture of esterquats is a mixture of monoesterquats, a diesterquat and a triesterquat. Under one embodiment, the mixture of esterquats is a mixture of monoesterquats, a diesterquat and triesterquats. Under one embodiment, the mixture of esterquats is a mixture of monoesterquats, diesterquats and a triesterquat. Under one embodiment, the mixture of esterquats is a mixture of monoesterquats, diesterquats and triesterquats.

The present invention is directed to a fabric conditioner composition comprising an esterquat, and a carbodiimide. Depending on the preparation procedures, an esterquat may be a mixture of esterquats is a mixture of monoesterquats, diesterquats and triesterquats. Under one embodiment the weight percent of the monoesterquats, diesterquats and triesterquats are equal to each other.

Under one embodiment, the esterquat comprises about 5 wt % to about 15 wt % of monoesterquats, about 5 wt % to about 15 wt % of diesterquats, and about 75 wt % to about 85 wt % of triesterquats. Under one embodiment, the esterquat comprises about 15 wt % to about 25 wt % of monoesterquats, about 5 wt % to about 15 wt % of diesterquats, and about 65 wt % to about 75 wt % of triesterquats. Under one embodiment, the esterquat comprises about 25 wt % to about 35 wt % of monoesterquats, about 5 wt % to about 15 wt % of diesterquats, and about 55 wt % to about 65 wt % of triesterquats. Under one embodiment, the esterquat comprises about 35 wt % to about 45 wt % of monoesterquats, about 5 wt % to about 15 wt % of diesterquats, and about 45 wt % to about 55 wt % of triesterquats. Under one embodiment, the esterquat comprises about 45 wt % to about 55 wt % of monoesterquats, about 5 wt % to about 15 wt % of diesterquats, and about 35 wt % to about 45 wt % of triesterquats. Under one embodiment, the esterquat comprises about 55 wt % to about 65 wt % of monoesterquats, about 5 wt % to about 15 wt % of diesterquats, and about 25 wt % to about 35 wt % of triesterquats. Under one embodiment, the esterquat comprises about 65 wt % to about 75 wt % of monoesterquats, about 5 wt % to about 15 wt % of diesterquats, and about 15 wt % to about 25 wt % of triesterquats. Under one embodiment, the esterquat comprises about 75 wt % to about 85 wt % of monoesterquats, about 5 wt % to about 15 wt % of diesterquats, and about 5 wt % to about 15 wt % of triesterquats. Under one embodiment, the esterquat comprises about 5 wt % to about 15 wt % of monoesterquats, about 15 wt % to about 25 wt % of diesterquats, and about 65 wt % to about 75 wt % of triesterquats. Under one embodiment, the esterquat comprises about 15 wt % to about 25 wt % of monoesterquats, about 15 wt % to about 25 wt % of diesterquats, and about 55 wt % to about 65 wt % of triesterquats. Under one embodiment, the esterquat comprises about 25 wt % to about 35 wt % of monoesterquats, about 15 wt % to about 25 wt % of diesterquats, and about 45 wt % to about 55 wt % of triesterquats. Under one embodiment, the esterquat comprises about 35 wt % to about 45 wt % of monoesterquats, about 15 wt % to about 25 wt % of diesterquats, and about 35 wt % to about 45 wt % of triesterquats. Under one embodiment, the esterquat comprises about 45 wt % to about 55 wt % of monoesterquats, about 15 wt % to about 25 wt % of diesterquats, and about 25 wt % to about 35 wt % of triesterquats. Under one embodiment, the esterquat comprises about 55 wt % to about 65 wt % of monoesterquats, about 15 wt % to about 25 wt % of diesterquats, and about 15 wt % to about 25 wt % of triesterquats. Under one embodiment, the esterquat comprises about 65 wt % to about 75 wt % of monoesterquats, about 15 wt % to about 25 wt % of diesterquats, and about 5 wt % to about 15 wt % of triesterquats. Under one embodiment, the esterquat comprises about 5 wt % to about 15 wt % of monoesterquats, about 25 wt % to about 35 wt % of diesterquats, and about 55 wt % to about 65 wt % of triesterquats. Under one embodiment, the esterquat comprises about 15 wt % to about 25 wt % of monoesterquats, about 25 wt % to about 35 wt % of diesterquats, and about 45 wt % to about 55 wt % of triesterquats. Under one embodiment, the esterquat comprises about 25 wt % to about 35 wt % of monoesterquats, about 25 wt % to about 35 wt % of diesterquats, and about 35 wt % to about 45 wt % of triesterquats. Under one embodiment, the esterquat comprises about 35 wt % to about 45 wt % of monoesterquats, about 25 wt % to about 35 wt % of diesterquats, and about 25 wt % to about 35 wt % of triesterquats. Under one embodiment, the esterquat comprises about 45 wt % to about 55 wt % of monoesterquats, about 25 wt % to about 35 wt % of diesterquats, and about 15 wt % to about 25 wt % of triesterquats. Under one embodiment, the esterquat comprises about 55 wt % to about 65 wt % of monoesterquats, about 25 wt % to about 35 wt % of diesterquats, and about 5 wt % to about 15 wt % of triesterquats. Under one embodiment, the esterquat comprises about 5 wt % to about 15 wt % of monoesterquats, about 35 wt % to about 45 wt % of diesterquats, and about 45 wt % to about 55 wt % of triesterquats. Under one embodiment, the esterquat comprises about 15 wt % to about 25 wt % of monoesterquats, about 35 wt % to about 45 wt % of diesterquats, and about 35 wt % to about 45 wt % of triesterquats. Under one embodiment, the esterquat comprises about 25 wt % to about 35 wt % of monoesterquats, about 35 wt % to about 45 wt % of diesterquats, and about 25 wt % to about 35 wt % of triesterquats. Under one embodiment, the esterquat comprises about 35 wt % to about 45 wt % of monoesterquats, about 35 wt % to about 45 wt % of diesterquats, and about 15 wt % to about 25 wt % of triesterquats. Under one embodiment, the esterquat comprises about 45 wt % to about 55 wt % of monoesterquats, about 35 wt % to about 45 wt % of diesterquats, and about 5 wt % to about 15 wt % of triesterquats. Under one embodiment, the esterquat comprises about 5 wt % to about 15 wt % of monoesterquat, about 45 wt % to about 55 wt % of diesterquats, and about 35 wt % to about 45 wt % of triesterquats. Under one embodiment, the esterquat comprises about 15 wt % to about 25 wt % of monoesterquats, about 45 wt % to about 55 wt % of diesterquats, and about 25 wt % to about 35 wt % of triesterquats. Under one embodiment, the esterquat comprises about 25 wt % to about 35 wt % of monoesterquats, about 45 wt % to about 55 wt % of diesterquats, and about 15 wt % to about 25 wt % of triesterquats. Under one embodiment, the esterquat comprises about 35 wt % to about 45 wt % of monoesterquats, about 45 wt % to about 55 wt % of diesterquats, and about 5 wt % to about 15 wt % of triesterquats.

Under one embodiment, the esterquat comprises about 5 wt % to about 15 wt % of monoesterquats, about 55 wt % to about 65 wt % of diesterquats, and about 25 wt % to about 35 wt % of triesterquats. Under one embodiment, the esterquat comprises about 15 wt % to about 25 wt % of monoesterquats, about 55 wt % to about 65 wt % of diesterquats, and about 15 wt % to about 25 wt % of triesterquats. Under one embodiment, the esterquat comprises about 25 wt % to about 35 wt % of monoesterquats, about 55 wt % to about 65 wt % of diesterquats, and about 5 wt % to about 15 wt % of triesterquats. Under one embodiment, the esterquat comprises about 5 wt % to about 15 wt % of monoesterquats, about 65 wt % to about 75 wt % of diesterquats, and about 15 wt % to about 25 wt % of triesterquats. Under one embodiment, the esterquat comprises about 15 wt % to about 25 wt % of monoesterquats, about 65 wt % to about 75 wt % of diesterquats, and about 5 wt % to about 15 wt % of triesterquats. Under one embodiment, the esterquat comprises about 5 wt % to about 15 wt % of monoesterquats, about 75 wt % to about 85 wt % of diesterquats, and about 5 wt % to about 15 wt % of triesterquats.

Under one embodiment, the esterquat is a mixture of about 20 wt % to about 40 wt % of monoesterquat, about 50 wt % to about 65 wt % of diesterquat, and about 10 wt % to about 25 wt % triesterquat.

Under one embodiment, the esterquat is a quaternary ammonium cation comprising fatty acid chains linked by weak ester linkages. $X^-$, the counterion for the quaternary ammonium cation, is a softener compatible anion. A "softener compatible anion" means a counterion that does not interfere with the stability, activity, or effectiveness of the softener. Under one embodiment, the softener compatible anion is an anion of a strong acid.

Examples of suitable softener compatible anions include chloride, bromide, methylsulfate, ethylsulfate, sulfate, phosphate, or nitrate, formate, lactate, benzoate, and mixtures thereof.

The esterquat may be present in any suitable amount. Under one embodiment, the esterquat is present in an amount of about 0.5 wt % to about 20 wt % of the fabric conditioner composition. In one embodiment, the esterquat is present in an amount of about 1.0 wt % to about 20 wt % of the fabric conditioner composition. In one embodiment, the esterquat is present in an amount of about 1.0 wt % to about 15 wt % of the fabric conditioner composition. In one embodiment, the esterquat is present in an amount of about 1.0 wt % to about 10 wt % of the fabric conditioner composition.

Under one embodiment esterquat is a quaternary ammonium compound that comprises two long ($C_{16-18}$) fatty acid chains with two weak ester linkages. Under one embodiment, esterquat is a quaternary ammonium compound of formula $[R^1R^2R^3N^+—(CH_2)_q—O—CO—R^4][X^-]$, wherein $R^4$ is an aliphatic hydrocarbyl group comprising 8 to 22 carbon atoms; $R^2$ and $R^3$ are each independently $—(CH_2)_s—R^5$, wherein $R^5$ is an alkoxy carbonyl group containing from 8 to 22 carbon atoms, benzyl, phenyl, $C_{1-4}$ alkyl substituted phenyl, OH, or H; $R^1$ is $—(CH_2)_t—R^6$, wherein $R^6$ is benzyl, phenyl, $C_{1-4}$ alkyl substituted phenyl, OH, or H; q, s, and t are each independently a number from 1 to 3; and $X^-$ is a softener compatible anion.

The percentages, by weight, of mono, di, and tri esterquats, as described above are determined by the quantitative analytical method described by A. J. Wilkes, C. Jacobs, G. Walraven and J. M. Talbot in "Characterisation of Quaternized Triethanolamine Esters (esterquats) by HPLC, HRCGC and NMR" 4th World Surfactants Congress, Barcelona, vol. 2, 3-7 Jun. 1996, page 389-402. The percentages, by weight, of the mono, di and tri esterquats measured on dried samples are normalized on the basis of 100%. The normalization is required due to the presence of 10% to 15%, by weight, of non-quaternized species, such as ester amines and free fatty acids. Accordingly, the normalized weight percentages refer to the pure esterquat component of the raw material. In other words, for the weight % of each of monoesterquat, diesterquat, and triesterquat, the weight % is based on the total amount of monoesterquat, diesterquat, and triesterquat in the composition.

In certain embodiments, the percentage of saturated fatty acids based on the total weight of fatty acids is about 45% to about 75%. Esterquat compositions using this percentage of saturated fatty acids do not suffer from the processing drawbacks of 100% saturated materials. When used in fabric softening, the compositions provide good consumer perceived fabric softness while retaining good fragrance delivery. In other embodiments, the amount is at least 50, 55, 60, 65 or 70 up to 75%. In other embodiments, the amount is no more than 70, 65, 60, 55, or 50 down to 45%. In other embodiments, the amount is 50 to 70%, 55 to 65%, or 57.5 to 67.5%. In one embodiment, the percentage of the fatty acid chains that are saturated is about 62.5% by weight of the fatty acid. In this embodiment, this can be obtained from a 50:50 ratio of hard:soft fatty acid.

By hard, it is meant that the fatty acid is close to full hydrogenation. In certain embodiments, a fully hydrogenated fatty acid has an iodine value of 10 or less. By soft, it is meant that the fatty acid is no more than partially hydrogenated. In certain embodiments, a no more than partially hydrogenated fatty acid has an iodine value of at least 40. In certain embodiments, a partially hydrogenated fatty acid has an iodine value of 40 to 55. The iodine value can be measured by ASTM D5554-95 (2006). In certain embodiments, a ratio of hard fatty acid to soft fatty acid is 70:30 to 40:60. In other embodiments, the ratio is 60:40 to 40:60 or 55:45 to 45:55. In one embodiment, the ratio is about 50:50. Because in these specific embodiments, each of the hard fatty acid and soft fatty acid cover ranges for different levels of saturation (hydrogenation), the actual percentage of fatty acids that are fully saturated can vary. In certain embodiments, soft tallow contains approximately 47% saturated chains by weight.

The percentage of saturated fatty acids can be achieved by using a mixture of fatty acids to make the esterquat, or the percentage can be achieved by blending esterquats with different amounts of saturated fatty acids.

The fatty acids can be any fatty acid that is used for manufacturing esterquats for fabric softening. Examples of fatty acids include, but are not limited to, coconut oil, palm oil, tallow, rape oil, fish oil, or chemically synthesized fatty acids. In certain embodiments, the fatty acid is tallow.

While the esterquat can be provided in solid form, it is usually present in a solvent in liquid form. In solid form, the esterquat can be delivered from a dryer sheet in the laundry. In certain embodiments, the solvent comprises water.

The esterquat is typically produced by reacting fatty acid methyl ester with alkanol amine followed by quaternization with dimethyl sulfate. In certain embodiments, the alkanol amine comprises triethanol amine. The fatty acids can be any fatty acid that is used for manufacturing esterquats for fabric softening. In any of the embodiments of the invention the fatty acid may comprises any fatty acid having from 12 to 22 carbon atoms, typically from 16 to 18 carbon atoms. Examples of fatty acids include, but am not limited to coconut oil, palm oil, tallow, rape oil, fish oil, or chemically synthesized fatty acids. In certain embodiments, the fatty acid is tallow.

The present invention is directed to a fabric conditioner composition comprising an esterquat, a carbodiimide, and optionally, additional ingredients. Such ingredients include fragrances, surfactants, thickening polymers, colorants, clays, buffers, chelating compounds, silicones, fatty alcohols, and fatty esters.

The composition can be provided as a fragrance free composition, or it can contain a fragrance. The amount of fragrance can be any desired amount depending on the preference of the user. In certain embodiments, the total amount of fragrance oil is 0.3 to 3 weight % of the composition. The fragrance can be in free form, encapsulated, or both.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

The fabric conditioner composition of the present invention may additionally contain a thickener. In one embodiment, the thickening polymer is the FLOSOFT™ DP200 polymer (available from SNF Floerger, Andrezieux, France). FLOSOFT™ DP200, is a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent. A suitable thickener is a water-soluble cross-linked cationic vinyl polymer which is cross-linked using a cross-linking agent of a difunctional vinyl addition monomer at a level of from 70 to 300 ppm, preferably from 75 to 200 ppm, and most preferably of from 80 to 150 ppm. Generally, such polymers are prepared as water-in-oil emulsions, wherein the cross-linked polymers are dispersed in mineral oil, which may contain surfactants. During finished product making, in contact with the water phase, the emulsion inverts, allowing the water soluble polymer to swell. The most preferred thickener is a cross-linked copolymer of a quaternary ammonium acrylate or methacrylate in combination with an acrylamide comonomer. The thickener in accordance provides fabric softening compositions showing long term stability upon storage and allows the presence of relatively high levels of electrolytes without affecting the composition stability. Besides, the fabric softening compositions remain stable when shear is applied thereto. In certain embodiments, the amount of this thickening polymer is at least 0.001 weight %. In other embodiments, the amount is 0.001 to 0.35 weight %.

The fabric conditioner composition may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DTPA). Suitable organo aminophosphonic acid compounds include: ethylenediamine tetrakis (methylenephosphonic acid); 1-hydroxyethane 1,1-diphosphonic acid (HEDP); and aminotri (methylenephosphonic acid). In certain embodiments, the composition can include amino tri methylene phosphonic acid, which is available as Dequest™ 2000 from Monsanto (Creve Coeur, Mo., USA). In other embodiments, the composition can include glutamic acid, N,N-diacetic acid, tetra sodium salt, which is available as Dissolvine™ GL from AkzoNobel (Amsterdam, Netherlands).

Under one embodiment, the fabric conditioner composition includes a $C_{13-15}$ fatty alcohol EO 20:1, which is a nonionic surfactant with an average of 20 ethoxylate groups. In certain embodiments, the amount is 0.05 to 0.5 weight %.

Under one embodiment, the fabric conditioner composition comprises a silicone as a defoamer, such as Dow Corning™ 1430 defoamer. In certain embodiments, the amount is 0.05 to 0.8 weight %.

Under one embodiment, the fabric conditioner composition comprises cetyl trimethyl ammonium chloride. In certain embodiments, cetyl trimethyl ammonium chloride is present in an amount of 0.001 to 5 weight %. When included, the cetyl trimethyl ammonium chloride in combination with the branched amine functional silicone reduces foam generation during laundering, which reduces the amount of rinsing needed.

EXAMPLES

Example 1

The impact of the use of carbodiimides on the triesterquat drop and monoesterquat drop was investigated.

Samples 1 to 3 fabric conditioner compositions based on triethanol amine tallow fatty acid triesterquat are prepared. For each of Samples 1 to 3, a first volume of deionized water was provided at a given temperature. A quaternary cationic surfactant, comprising an aqueous solution of a monohexadecyl quaternary ammonium cationic surfactant having 60 wt % active content, was added to the water in an amount so as to comprise 0.37 wt % of the final composition. The resultant mixture was mixed using a high shear mixer.

Esterquat HS90 (available from Stepan Company, Northfield, Ill., USA) was added in an amount as to comprise 4.5 wt % of the final composition. True Love E fragrance and triclosan were added in amounts as to comprise 0.6 wt % and 0.03 wt % of the final composition.

Carbodilite V02, a waterborne polycarbodiimide resin with hydrophilic segments, available from Nisshinbo Chemical Inc. (Chuo-ku, Tokyo, Japan), was added in an amount as to comprise 0.3 wt % of the final composition to Sample 2. Carbodilite SV02, a waterborne polycarbodiimide resin with hydrophilic segments, available from Nisshinbo Chemical Inc., was added in an amount as to comprise 0.3 wt % of the final composition to Sample 3. No polycarbodiimide was added to the comparative formulation of Sample 1. Sufficient amount of hydrochloric acid was added to the compositions of Samples 2 and 3 to lower the pH from above 8 to a pH of 3.

Finally, a second volume of water, Q.S. 100%, was added to make the final composition. The resultant mixture was mixed using the high shear mixer for a further period of 4 minutes. This formed in each of Samples 1 to 3 an aqueous emulsion of particles of a mixture of the triesterquat and the cationic surfactant. Dynamic viscosity of the samples was measured on Brookfield RVT, using spindle No. 1 at 10 rpm, at 25° C. Zeta-potential of the three examples was determined by a routine procedure.

Triesterquat drop and monoesterquat drops were determined by measuring the level of triesterqu+at and monoesterquat before and after aging. Aging was performed by leaving the samples at 50° C. for 4 weeks. The determination of the esterquat levels was performed by using procedures adopted from "Characterisation of Quaternized Triethanolamine Esters (Esterquats) by HPLC, HRCGC and NMR" A. J. Wilkes, C. Jacobs, G. Walraven and J. M. Talbot, Colgate Palmolive R&D Inc., Proceeding Fourth World Surfactants Congress, Barcelona, Vol. 2, 3-7 Jun. 1996, page 389-402.

The results of these experiments are presented in Table 1 (below)

TABLE 1

| Sample | V02 | SV02 | Viscosity (cP) | Zeta-potential (mV) | DSC ΔH (J/g) | Triester drop (molar %) | Monoester drop (molar %) |
|---|---|---|---|---|---|---|---|
| 1 | | | 15.6 | 279.2 | 0.61 | 1.1 | 7.0 |
| 2 | 0.3 wt % | | 22.8 | 208.5 | 0.47 | 1.1 | 4.4 |
| 3 | | 0.3 wt % | 17.6 | 266.6 | 0.62 | 1.0 | 4.0 |

The data described in Table 1 (below) demonstrates that monoesterquat dropped from about 7.0 mol % to about 4.0-4.4 mol %. This indicates that the hydrolysis of the esterquat has been mitigated by the addition of the polycarbodiimide.

Example 2

The effect of the esterquat base odor reduction by the addition of carbodiimides was studied. Four samples were prepared in a similar manner as in the previous experiment. Esterquat HS90 was added in an amount as to comprise 4.5 wt % of the final composition for Samples 5 to 7; Esterquat GEM1.7 (available from Eastman Chemical Company, Tennessee, USA_) was added in an amount as to comprise 4.5 wt % of the final composition for Samples 4. Carbodilite V02 and SV02 were added to Samples 6 and 7, respectively. The results of these experiments are described in Table 2 (below).

TABLE 2

| Sample | Esterquat GEM 1.7 | V02 | SV02 | Zeta-potential (mV) | Fatty odor |
|---|---|---|---|---|---|
| 5 | 4.5 wt % | | | 136.2 | Strong |
| 6 | 4.5 wt % | 0.3 wt % | | 126.3 | Weaker |
| 7 | 4.5 wt % | | 0.3 wt % | 142.9 | Weakest |

The data described in Table 2 (below) shows that the unique combination of a carbodiimide and a fabric conditioner containing esterquat, can reduce hydrolysis and mediate residual fatty odor from esterquats.

While the present invention has been described with reference to several embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention is to be determined from the claims appended hereto. Further, it will be apparent to those of skill in the art that numerous changes may be made in such details without departing from the spirit and the principles of the invention.

What is claimed is:

1. A fabric care composition comprising:

(a) an esterquat, and (b) a carbodiimide, wherein the carbodiimide is a compound of formula:

$$R—N=C=N—R'$$

wherein:

R and R' are each independently $C_{1-6}$ alkyl, aryl, cycloalkyl, or $—(CH_2)_xNR^mR^n$; wherein x is a number from 1 to 5; and $R^m$ and $R^n$ are each independently H or $C_{1-6}$ alkyl;

wherein the carbodiimide is a dimer of a compound of formula R—N=C=N—R', wherein R and R' are each independently is a $C_{1-6}$ alkyl, aryl, cycloalkyl, or $—(CH_2)_xNR^mR^n$; wherein x is an integer from 1 to 3, $R^m$ and $R^n$ are each independently $C_{1-6}$ alkyl; or wherein the carbodiimide is a polymer of a compound of formula R—N=C=N—R', wherein R and R' are each independently is a $C_{1-6}$ alkyl, aryl, cycloalkyl, or $—(CH_2)_xNR^mR^n$; wherein x is an integer from 1 to 3, $R^m$ and $R^n$ are each independently $C_{1-6}$ alkyl.

2. The fabric care composition according to claim 1, wherein the carbodiimide is present in an amount of 0.3% by weight, based on the total weight of the composition.

3. The fabric care composition according to claim 1, wherein the carbodiimide is selected from the group consisting of N,N'-dicyclohexylcarbodiimide, N,N'-diisopropylcarbodiimide, N,N'-diphenylcarbodiimide, N-(3-dimethylaminopropyl)-N'-ethylcarbodiimide, N-ethyl-N'-(3-dimethylaminopropyl)carbodiimide, 1-[3-(dimethylamino)propyl]-3-ethylcarbodiimide methiodide, N-(3-dimethylaminopropyl)-N'-ethylcarbodiimide, a polymer thereof, and mixture thereof.

4. The fabric care composition according to claim 1, wherein the carbodiimide is selected from the group consisting of 1-ethyl-3-(3-dimethylaminopropyl)carbodiimide, and mixture thereof.

5. The fabric care composition according to claim 1, wherein the carbodiimide is water dispersible.

6. The fabric care composition according to claim 1, wherein the esterquat is a quaternary ammonium compound of formula:

$$[R^aR^bR^cR^dN^+][X^-]$$

wherein:

$R^a$, $R^b$ and $R^c$ are each independently $—(CH_2)_g—R^e$, $R^e$ is OH or an alkoxy hydrocarbyl group containing from 8 to 22 carbon atoms;

$R^d$ is a hydrocarbyl group comprising 1 to 12 carbon atoms;

g is a number from 1 to 3; and $X^-$ is a softener compatible anion.

7. The fabric care composition according to claim 6, wherein the hydrocarbyl group is an aliphatic group containing 0 to 3 double bonds.

8. The fabric care composition according to claim 6, wherein the aliphatic group is linear.

9. The fabric care composition according to claim 1, wherein the esterquat is a quaternary ammonium compound of formula:

$$[R^1R^2R^3N^+—(CH_2)_q—O—CO—R^4][X^-]$$

wherein:

$R^4$ is an aliphatic hydrocarbyl group comprising 8 to 22 carbon atoms;

$R^2$ and $R^3$ are each independently $—(CH_2)_s—R^5$;

$R^5$ is an alkoxy carbonyl group containing from 8 to 22 carbon atoms, benzyl, phenyl, $C_{1-4}$ alkyl substituted phenyl, OH, or H;

$R^1$ is $—(CH_2)_t—R^6$;

$R^6$ is benzyl, phenyl, $C_{1-4}$ alkyl substituted phenyl, OH, or H;

q, s, and t are each independently a number from 1 to 3; and $X^-$ is a softener compatible anion.

10. The fabric care composition according to claim 1, wherein the fabric care composition further comprises a cationic surfactant.

11. The fabric care composition according to claim 1, wherein the esterquat is a mixture of about 20 wt % to about 40 wt % of monoesterquat, about 50 wt % to about 65 wt % of diesterquat, and about 10 wt % to about 25 wt % triesterquat.

12. The fabric care composition according to claim 1, wherein the fabric care composition is substantially free of visually perceivable particulate matter after four (4) weeks at 50° C.

13. The fabric care composition according to claim 1, wherein the fabric care composition has a shelf-life of greater than about 2 years.

* * * * *